US005326065A

United States Patent [19]

Jackson

[11] Patent Number: 5,326,065

[45] Date of Patent: Jul. 5, 1994

[54] FOOT OR TOP PLATE ASSEMBLY

[76] Inventor: George W. Jackson, 2570 Drew Road, Mississauga, Ontario, Canada, L4T 3M5

[21] Appl. No.: 996,743

[22] Filed: Dec. 24, 1992

[51] Int. Cl.[5] ..... E04G 25/00

[52] U.S. Cl. ..... 248/351; 248/354.5; 248/357

[58] Field of Search ..... 248/351, 354.1, 354.5, 248/354.4, 357; 182/178, 179; 403/374, 49

[56] References Cited

U.S. PATENT DOCUMENTS

| | | | |
|---|---|---|---|
| 988,948 | 4/1911 | Reinhard | 248/357 X |
| 1,374,598 | 4/1921 | Markham | 248/357 X |
| 1,570,226 | 1/1926 | Bosco | 248/354.5 X |
| 2,539,703 | 1/1951 | Sato | 248/357 X |
| 2,635,844 | 4/1953 | Sato | 248/357 |
| 3,847,340 | 11/1974 | Ficken et al. . | |
| 3,870,268 | 3/1975 | Larkin | 248/354.4 X |
| 4,036,466 | 7/1977 | Van Meter . | |
| 4,147,321 | 4/1979 | Gostling | 248/357 X |
| 4,470,574 | 9/1984 | Jackson . | |
| 5,160,109 | 11/1992 | de Leeuw | 248/354.4 |

FOREIGN PATENT DOCUMENTS

| | | | |
|---|---|---|---|
| 801536 | 1/1951 | Fed. Rep. of Germany | 248/354.5 |
| 428055 | 4/1935 | United Kingdom | 248/354.4 |
| 1022919 | 3/1966 | United Kingdom | 248/354.5 |

*Primary Examiner*—David A. Scherbel
*Assistant Examiner*—Derek J. Berger
*Attorney, Agent, or Firm*—Jeffrey T. Imai; Arne I. Fors; D. Doak Horne

[57] ABSTRACT

A foot or top plate assembly for a shoring structure or tower comprises a wedged pin, a screw jack having an end adapted to receive the wedged pin in a friction fit, a foot plate having a first support for receiving the wedged pin in a friction fit and a second support for supporting the wedged pin. The first and second supports adapted to receive the hollow end in a sliding fit. The wedged pin connects the foot plate to the screw jack, whereby as the wedged pin is moved between an engaged position and a disengaged position the base plate moves relative to the screw jack.

16 Claims, 4 Drawing Sheets

FOOT OR TOP PLATE ASSEMBLY

FIELD OF INVENTION

This invention relates to a foot or top plate assembly for a shoring structure or tower. In particular, this invention relates to an assembly capable of supporting heavy loads and capable of quickly releasing to reduce the pressure forces acting on screw jacks supporting the shoring structure or tower.

DESCRIPTION OF THE PRIOR ART

Scaffolding can be assembled to construct platforms for workers, equipment and materials and also for shoring or support structures. Scaffolding usually consists of frames, saddlebeams and crossbracing which can be interconnected to form a shoring structure or tower. The frames are mounted on screw jacks to accommodate the shoring structure or tower to the support surface. The operation and details of scaffolding and connectors are more particularly described in U.S. Pat. Nos. 4,470,574 and 5,112,155.

Screw jacks are used to raise or lower the shoring structure or tower. Screw jacks generally comprise a shaft having a thread on the external surface and a wing nut. The screw jack shaft fits inside of a hollow frame while the frame rests on the wing nut. The shoring structure or tower is then raised or lowered by screwing and unscrewing the wing nut along the threaded shaft.

In many construction applications, the load on each leg of the shoring structure or tower does not normally exceed 4,500 kg (10,000 pounds). However during the construction of large concrete structures such as dams or bridges, a shoring structure or tower is required to support the forms and the poured concrete. The loading on the shoring structure or tower can easily exceed 6,000 kg (13,500 pounds) per leg.

The wing nuts of the screw jacks can be easily manipulated for loading up to approximately 2,600 kg (6,000 pounds) per jack. However when the shoring structure or tower is subjected to heavier loads, the wing nuts of the screw jacks become difficult to unscrew. The loading pressure on the screw prevents the wing nut from being retracted along the screw thread. Consequently, it becomes very difficult to retract the nut without damaging the nut.

A coarser threading on the screw jack could be selected which will permit the unscrewing of the wing nut under reasonably heavier loads. However, the greater the pitch of the thread, the more difficult and time consuming it is to raise the shoring structure or tower for adjustment. Under extreme loading and with a coarse thread, the wing nut may still be difficult to unscrew.

Hollow pipes or tubes can be applied to one of the wings of the wing nut to increase the turning leverage on the nut. Hammers are also used to unscrew the nut. However when the loading becomes extreme, the increased leverage will often bend or shear off the wing and heavy hammer blows will damage the nut. The end result is a sheared or damaged wing.

Footings for shoring structures or towers can be mounted in sandboxes filled with sand. The sandboxes have plugged holes. The shoring structure or tower is assembled and loaded with each foot mounted in each sandbox. To relieve the pressure on the jacks, the holes in the sandboxes are unplugged allowing the sand to run out increasing the clearance between the support surface and the supported structure thereby reducing the load on the shoring structure or tower and jacks. The screw jacks may then be manipulated.

While the sandbox system does provide a system for unloading the screw jacks of the shoring structure or tower, the sandbox system is difficult and time consuming to set up and use. As a result, the moving, setting and storing of these sandboxes create additional expenses and require additional skill and effort to install.

SUMMARY OF THE INVENTION

The disadvantages of the prior art may be overcome by providing a foot or top plate and screw jack assembly for a shoring frame which is capable of being quickly reduced in relative length to reduce the loading thereon.

It is desirable to provide a foot and screw jack assembly which is connected through a wedged pin having a wedged position inserted between the screw jack and foot and adapted for transferring loads thereacross and a disengaged position for transferring loads from the screw jack directly to the foot.

It further desirable to provide a wedged pin which is conical in shape whereby the foot may pivot with respect to the screw jack.

According to one aspect of the invention, there is provided a foot or top plate assembly comprising, a wedged pin, a screw jack having a hollow end adapted to receive the wedged pin in a friction fit, a foot plate having a support means for receiving the wedged pin in a friction fit and a pin support means for supporting the wedged pin and the first and second support means adapted to receive the hollow end in a sliding fit, the wedged pin connecting the foot plate to the screw jack, whereby as said wedged pin is moved between a fully engaged position and a disengaged position said base plate moves relative to the screw jack.

According to another aspect of the invention, there is provided a foot or top plate assembly comprising, a screw jack shaft having a hollow end and a threaded end, the threaded end having an external thread adapted to receive a wing nut, the hollow end having a first bore of a first diameter and a second bore of a second diameter, the first bore in substantial alignment with the second bore, a base plate having a first and second support plate, the first support plate having a third bore of a third diameter and the second support plate having a fourth bore of a fourth diameter, the third bore in substantial alignment with the fourth bore, the first plate spaced from the second plate for slidingly receiving the hollow end of the screw jack, and a wedged pin for extending through the bores, the bores adapted to receive the wedged pin in a frictional fit, the base plate having a pin support member extending substantially perpendicular thereto and adapted for supporting the wedged pin intermediate of the first and second support plate, the wedged pin connecting the base plate to the screw jack, whereby as the wedged pin is moved between a fully engaged position and a disengaged position the base plate moves relative to the screw jack.

BRIEF DESCRIPTION OF THE DRAWINGS

The invention, as exemplified by a preferred embodiment, is described with reference to the drawings in which.

DESCRIPTION OF THE PREFERRED EMBODIMENTS

Figure 1:
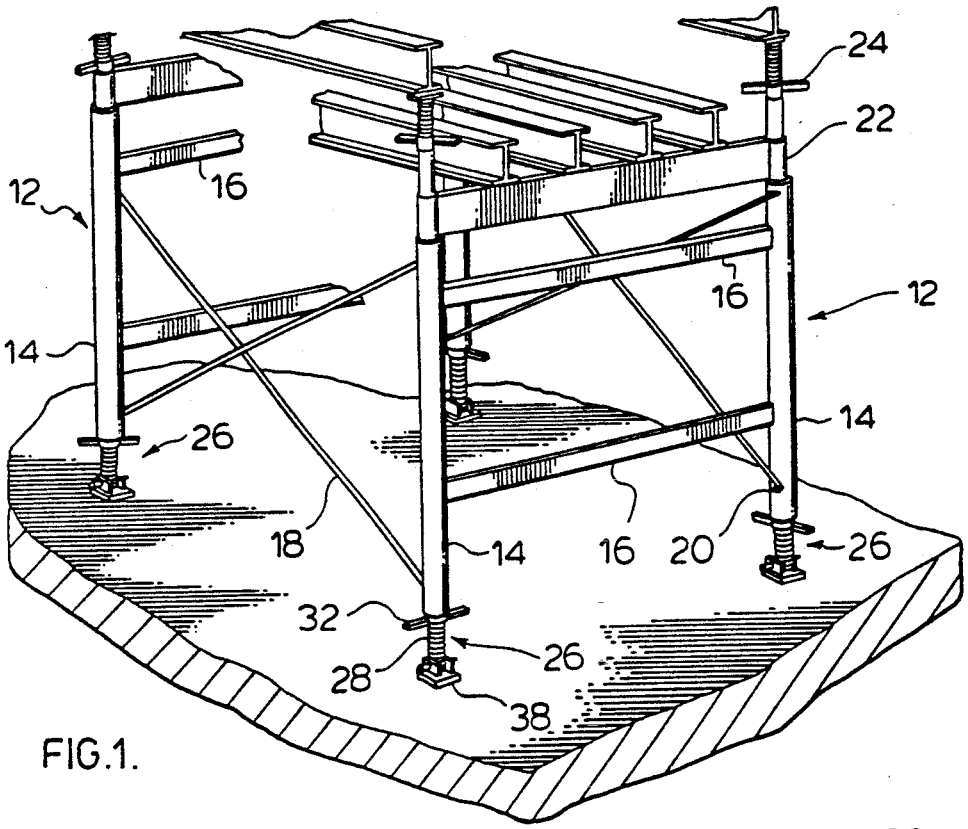
FIG. 1 is a perspective view of a shoring structure or tower including the foot assembly of the present invention.

Referring to FIG. 1, a shoring structure or tower is illustrated. The shoring structure or tower comprises end frames 12 having hollow legs 14 and cross beams 16. Frames 12 are joined together using cross-bracing 18 and connectors 20. At the upper end of frames 12 are saddlebeams 22 and screw jacks 24 for adapting the shoring structure or tower to support various construction forms. At the lower end of legs 14 are foot assemblies 26.

Figure 7:
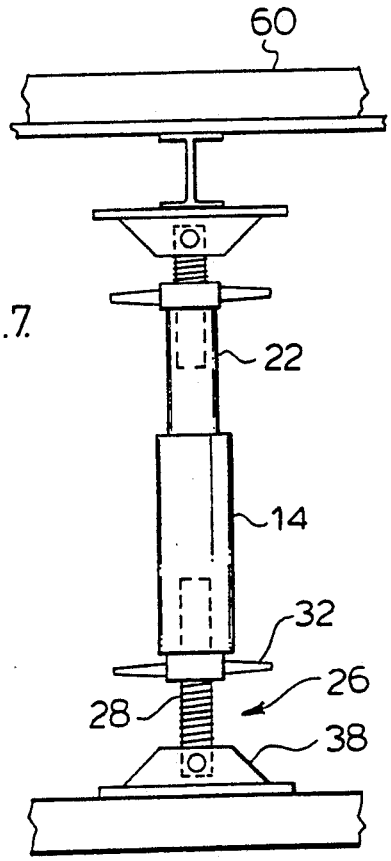
FIG. 7 is a front elevational view of the invention of FIG. 1 illustrating the assembly in an engaged condition.
Figure 8:
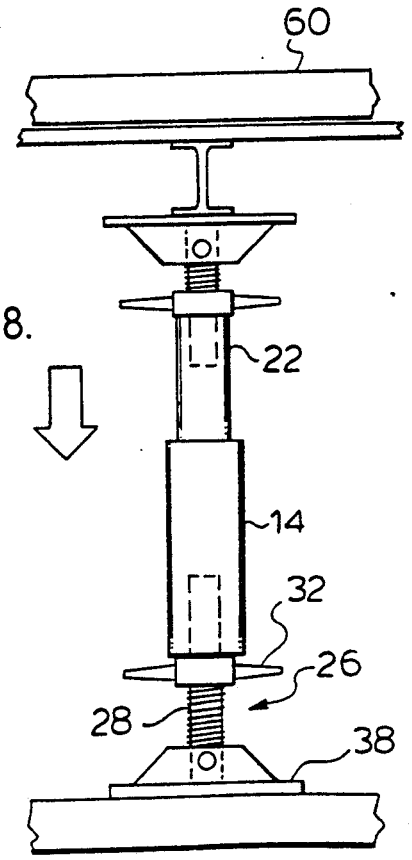
FIG. 8: is a front elevational view of the invention of FIG. 1 illustrating the assembly in a disengaged position.
Figure 2:
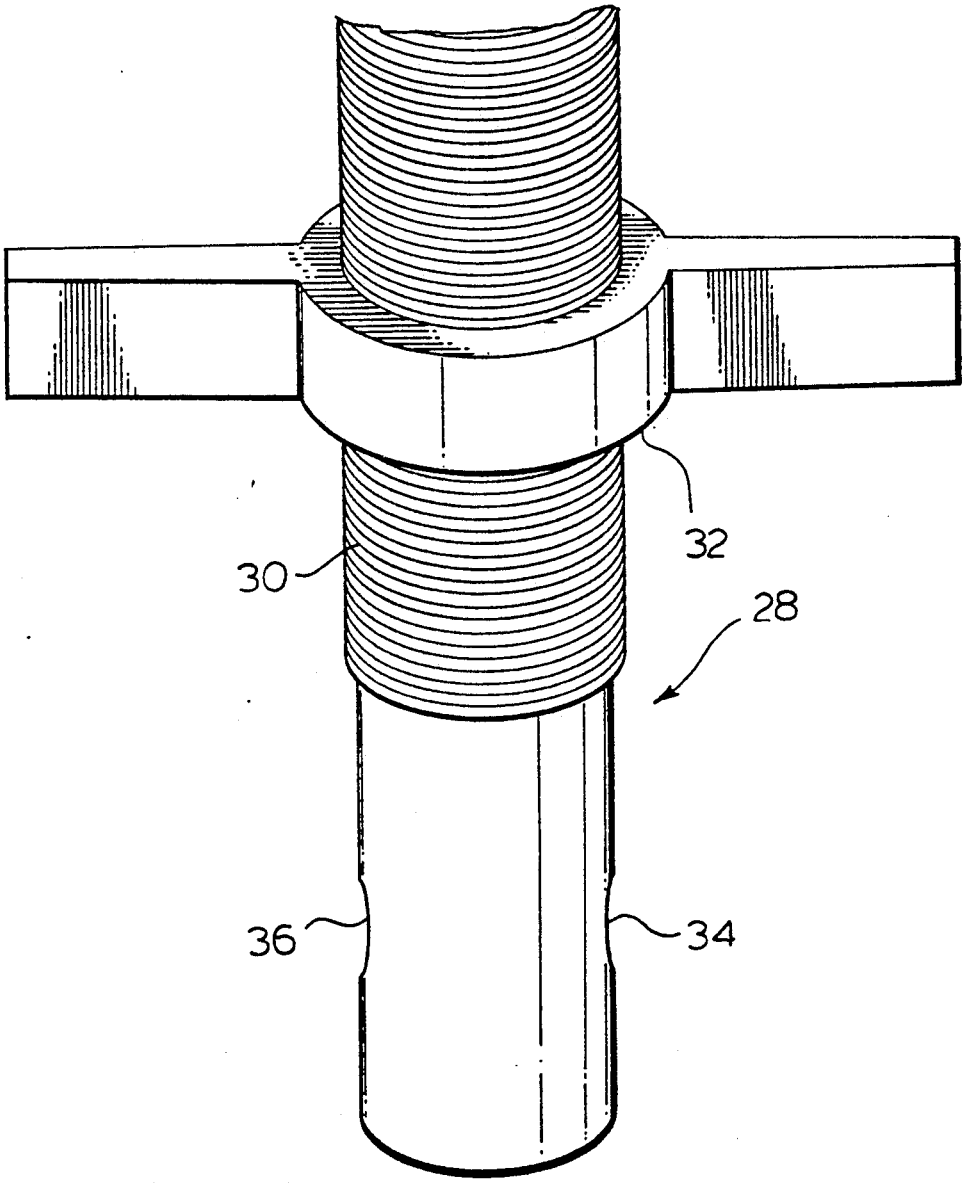
FIG. 2 is a perspective view of the screw jack shaft of the invention of FIG. 1.

Referring to FIGS. 2, 7 and 8, foot assemblies 26 have a cylindrical shaft 28 which extends up into the hollow leg 14 of frame 12. Shaft 28 has an external thread 30. Wing nut 32 is in threaded engagement with thread 30. Hollow legs 14 will rest on the wing nut 32. Shaft 28 has at one end a pair of bores 34 and 36 which are diametrically opposed. Bore 34 has a diameter greater than that of bore 36, for reasons which will become apparent. Shaft 28 can be machined from an extruded tube of aluminum.

Figure 3:
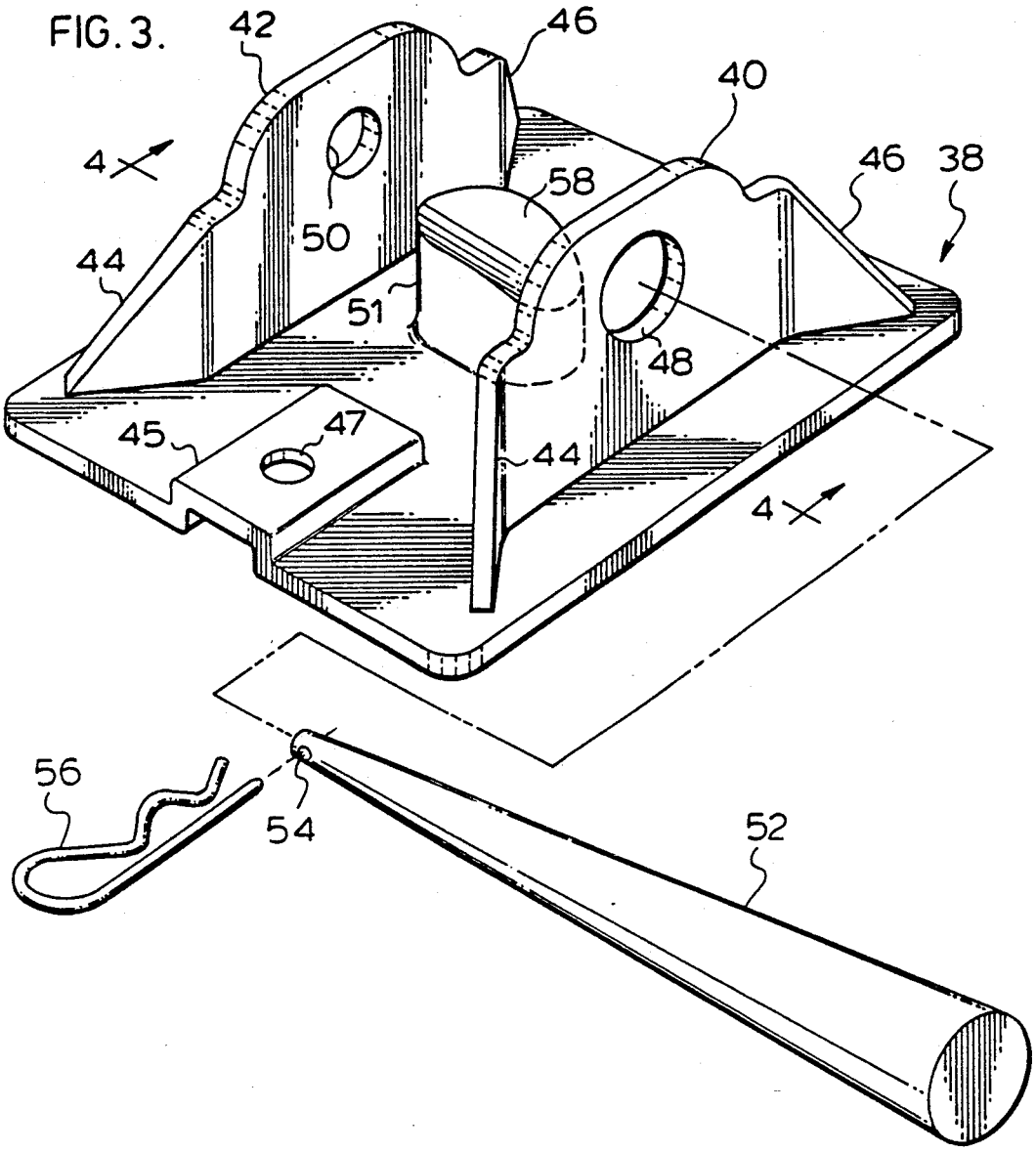
FIG. 3 is an exploded perspective view of the foot and pin of the invention of FIG. 1.

Referring to FIG. 3, foot assemblies 26 has a rectangular base plate 38. Base 38 has two support plates 40 and 42 extending substantially perpendicular to base plate 38. Support plates 40 and 42 may be structurally reinforced by providing flanges 44 and 46 at each end thereof. Base plate 38 can be casted using a carbon steel.

Base plate 38 may also have mounting platforms 45 having a bore 47 to receive screws (not illustrated) to connect the foot assembly to a base such as an aluminum stringer or joist beam as illustrated in U.S. Pat. No. 4,470,574.

Support plate 40 has a bore 48 and support plate 42 has a concentric bore 50 defining a central axis substantially parallel to the base plate 38. Bore 48 has a diameter greater than that of bore 50. The diameters of bores 34 and 36 will be substantially the same as are the diameters of bores 48 and 50, respectively. However in the preferred embodiment, the bores 48, 34, 36 and 50 diminish is size for reasons which are explained below.

The bores 48 and 50 are spaced from the base plate 38 a distance which exceeds the distance between bores 34 and 36 of shaft 28 and the hollow end of the shaft 28 to allow for relative movement therebetween. Support plates 40 and 42 are spaced apart from each other. Shaft 28 is able to fit between support plates 40 and 42 in a sliding fit.

Pin support 51 extends between support plates 40 and 42 and substantially in line with the central axis. Pin support 51 has a length less than the inside diameter of shaft 28 allowing the pin support 51 to extend into the shaft 28.

Figure 4:
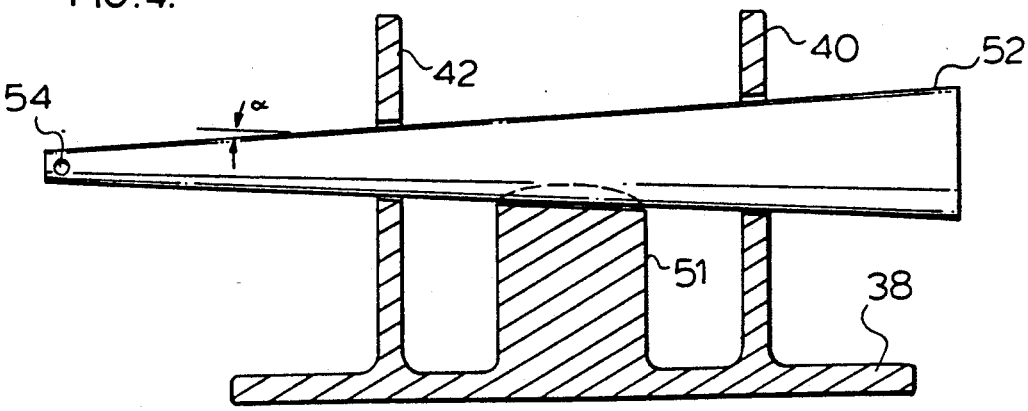
FIG. 4 is a cross-sectional view of the foot plate of the invention taken along plane 1—1 of FIG. 1.

Referring to FIGS. 3 and 4, a wedged pin 52 has a tapered shape which has a rate of taper corresponding to the difference in diameters and distance between bores 48 and 50. The rate of taper will depend upon the expected loads for the foot assembly, the amount of clearance which will be required to unload the screw jacks and the diameter of the shaft of the screw jack. The rate of taper can be in the range of 2 and 10 degrees. In the preferred embodiment, pin 52 has an elongated cone shape having a taper angle $\alpha$ of approximately 3 degrees. Pin 52 will frictionally fit within bores 48 and 50 when in an engaged position.

Pin 52 has a bore 54 in the tapered end of the pin for receiving a pin 56. Pin 56 is serpentine in shape to hold the pin 52 in place after assembly. Pin 52 is preferably machined and polished from a carbon steel.

Figure 5:
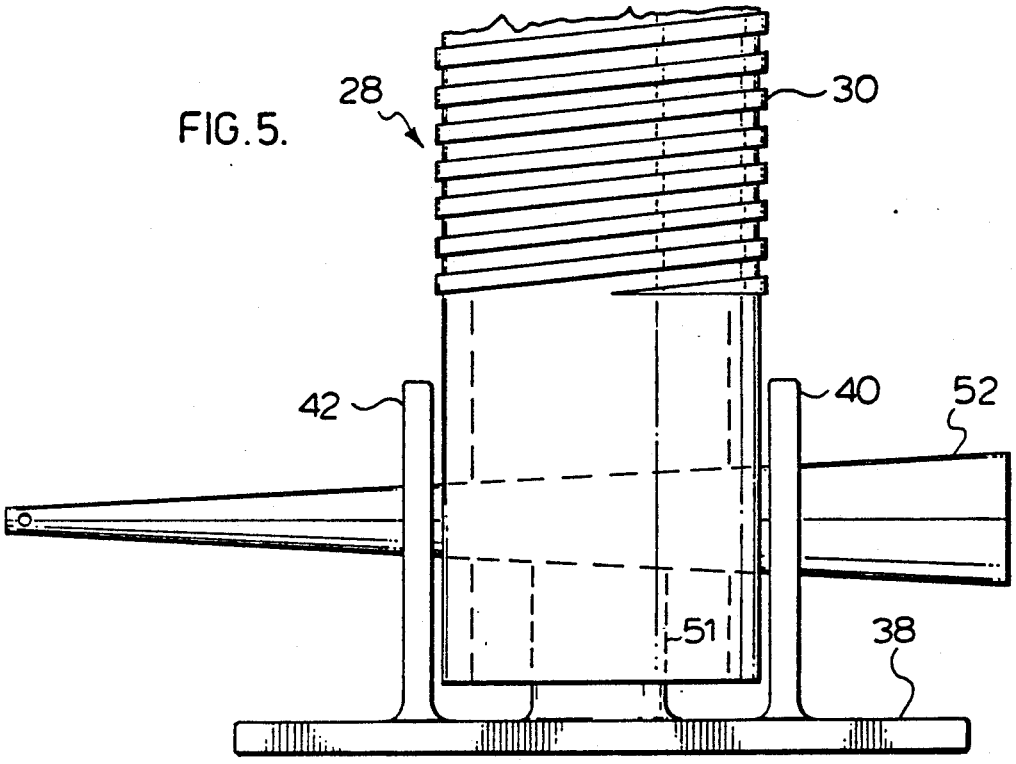
FIG. 5 is a front elevational view of the footing of the invention of FIG. 1 illustrating the foot in an engaged position.

Referring to FIGS. 5, foot assembly 26 has the connecting pin 52 inserted through the bores 48 and 50 of base plate 38 and through bores 34 and 36 of shaft 28. Bores 48 and 50 and 34 and 36 are tapered at the taper angle $\alpha$ to frictionally receive the pin 52 when the pin 52 is in an engaged position. The upper surface of pin support 51 has a concave top surface 58 for cradling and supporting the connecting pin 52.

The foot assembly 26 is assembled by aligning the bores 34 and 36 of shaft 28 with the bores 48 and 50 of support members 40 and 42 and fully inserting the pin 52 therethrough connecting the base plate 38 and shaft 28 together. Pin 56 is inserted through bore 54 to lock the pin therein. Since the pin 52 is an elongated cone shape, base plate 38 is able to pivot with respect to shaft 28. This feature is particularly advantageous in conditions where the support surface where the shoring structure or tower is to be assembled is uneven.

In this engaged position, pin 52 will frictionally fit within bores 48, 34, 36 and 50 and will be resting upon pin support 51. The screw jack is urged relatively away from the base plate 38. In this position, the foot is capable of being loaded. The load is transmitted from the shaft 28 to the pin 52 and then to the support plates 40 and 42 and the pin support 51. In the preferred embodiment, each such foot may be loaded in excess of 11,300 kg (25,000 pounds).

Figure 6:
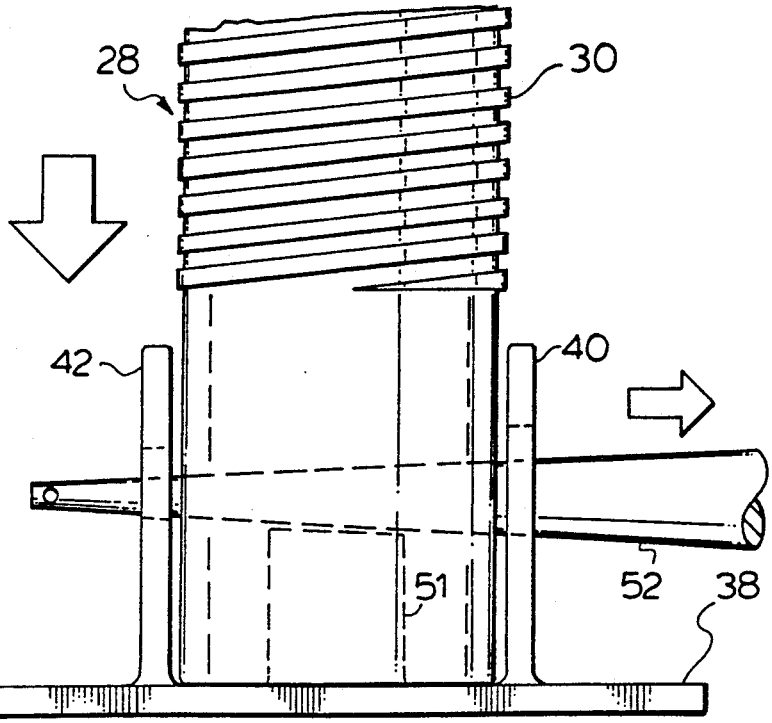
FIG. 6 is a front elevation view of the footing of the invention of FIG. 1 illustrating the foot in a disengaged position.

Referring to FIGS. 6, 7 and 8, the footing assembly 26 is unloaded by forcing the connecting pin 52 towards the thicker end as indicated by the arrow to a disengaged position. A hammer or other instrument may be used to forcibly move the pin 52 across. As the pin 52 moves across, the shaft 28 will move relatively towards the base plate 38 in a wedge-like manner reducing the distance between the shaft 28 and base plate 38. Where the loading on the shoring structure or tower is stationary such as in concrete pouring, the wedging of pin 52 will decrease the height of the shoring structure or tower. Since concrete floor 60 remains stationary, the compressive loads on the shoring structure or tower are reduced. After the pin 52 has been wedged outwardly to a disengaged position, the wing nut 32 may be unscrewed to fully unload the scaffolding for disassembly. In a fully disengaged position, the shaft 28 will rest directly on the base plate 38 for load transfer.

As illustrated in FIGS. 7 and 8, the foot assembly may also be installed at the head of the shoring structure or tower. By including the foot assembly at the head, an increased amount of play or clearance may be achieved to further reduce the loading on the screw jack wing nuts.

It apparent that the pin 52 may have a rectangular or square cross-section, provided the upper and lower surfaces were tapered in a wedge shape. The bores 34, 36 and 48, 50 would require a corresponding cross-section to be efficient. However, the base plate would not be able to pivot with respect to the screw jack.

It is also apparent that other material may be used for the components of the foot assembly. Hollow or solid steel may be used to manufacture the shafts 28. Base plate 28 may be casted with iron or even aluminum or may even be machined from such metals. Base plate 28 may also be of any desired shape and size provided the base plate 28 adequately supports and transfers the expected loads.

In the preferred embodiment, the taper angle $\alpha$ of approximately 3 degrees is described. However depending on the loading requirements, a taper angle $\alpha$ of between 2 and 10 degrees may be used.

Although in the preferred embodiment the pin and corresponding bores through which the pin extends are described as being round, it is apparent that the pin and bores could be any configuration provided the pin is able to provide the wedge action required for the invention.

Although the disclosure describes and illustrates the preferred embodiments of the invention, it is understood that the invention is not limited to these particular embodiments. Many variations and modifications will now occur to those skilled in the art. For definition of the invention, reference is made to the appended claims.

I claim:

1. A foot or top plate assembly for a shoring structure or tower, said assembly comprising:

a wedged pin having an elongated cone shape having a taper, a screw jack shaft having a hollow end adapted to receive the wedged pin in a friction fit in an engaged position, a base plate having a support means for receiving the wedged pin in a friction fit and said support means adapted to receive said hollow end in a sliding fit, said wedged pin pivotally connecting the base plate to the screw jack, whereby as said wedged pin is moved between said engaged position and a disengaged position relative movement between said base plate and said screw jack is effected.

2. A foot or top plate assembly in claim 1 wherein said paper is between 2 to 10 degrees.

3. A foot or top plate assembly as claimed in claim 2 wherein said support means is a first and second plate extending substantially perpendicular to the base plate and spaced apart to slidingly receive the screw jack.

4. A foot or top plate assembly as claimed in claim 3 wherein said assembly further comprises a pin support means for supporting the wedged pin.

5. A foot or top plate assembly as claimed in claim 4 wherein said pin support means is an abutment member extending substantially perpendicular to the base plate and spaced between said first and second plates and sized to extend into the hollow end, said pin support means adapted to support said wedged pin intermediate of the support means.

6. A foot or top plate assembly as claimed in claim 5 wherein said hollow end has a first bore of a first diameter and a second bore of a second diameter, said first bore in transverse alignment with the second bore, said first plate has a third bore of a third diameter and said second plate has a fourth bore of a fourth diameter, said third bore in substantial alignment with the fourth bore, and the rate of difference in the said diameters corresponds to the taper of the wedged pin.

7. A foot or top plate assembly as claimed in claim 6 wherein said bores are tapered to frictionally receive said wedged pin.

8. A foot or top plate assembly as claimed in claim 7 wherein said pin is forcibly moved from the engaged position to the disengaged position while the foot or top plate assembly is under a compressive load urging the screw jack towards the base plate.

9. A foot or top plate assembly as claimed in claim 8 wherein said taper is 3 degrees.

10. A foot or top plate assembly comprising, a screw jack having a hollow end and a threaded end, said threaded end having an external thread adapted to receive a wing nut, said hollow end having a first bore of a first diameter and a second bore of a second diameter, said first bore in substantial alignment with the second bore, a base plate having a first and second support plate, said first support plate having a third bore of a third diameter and said second support plate having a fourth bore of a fourth diameter, said third bore in substantial alignment with the fourth bore, said first plate spaced from the second plate for slidingly receiving said hollow end of said screw jack, and a wedged pin for extending through said bores, said bores adapted to receive the wedged pin in a frictional fit, said base plate having a pin support member extending substantially perpendicular thereto and adapted for supporting said wedged pin intermediate of the first and second support plate, said wedged pin having an elongated cone shape having a taper for pivotally connecting the base plate to the screw jack, whereby as said wedged pin is moved between an engaged position and a disengaged position said base plate moves towards and away from the screw jack.

11. A foot or top plate assembly as claimed in claim 10 wherein said taper is between 2 to 10 degrees.

12. A foot or top plate assembly as claimed in claim 10 wherein said bores are tapered to frictionally receive said wedged pin.

13. A foot or top plate assembly as claimed in claim 10 wherein said pin is forcibly moved from the engaged position to the disengaged position while the foot or top plate assembly is under a compressive load urging the screw jack towards the base plate.

14. In a combination with a shoring structure or tower, a foot or top plate assembly comprising, a wedged pin having an elongated cone shape having a taper, a screw jack shaft having a hollow end adapted to receive the wedged pin in a friction fit in an engaged position, a base plate having a support means for receiving the wedged pin in a friction fit and adapted to receive said hollow end in a sliding fit, said wedged pin pivotally connecting the base plate to the screw jack, whereby as said wedged pin is moved between said engaged position and a disengaged position relative movement between said base plate and said screw jack is effected.

15. The foot or top plate assembly as claimed in claim 14 wherein said taper is between 2 to 10 degrees.

16. The foot or top plate assembly as claimed in claim 14 wherein said taper is 3 degrees.

* * * * *